US007908867B2

(12) United States Patent
Keller et al.

(10) Patent No.: US 7,908,867 B2
(45) Date of Patent: Mar. 22, 2011

(54) WAVY CMC WALL HYBRID CERAMIC APPARATUS

(75) Inventors: Douglas A. Keller, Kalamazoo, MI (US); Anthony L. Schiavo, Oviedo, FL (US); Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 782 days.

(21) Appl. No.: 11/855,623

(22) Filed: Sep. 14, 2007

(65) Prior Publication Data

US 2009/0071160 A1 Mar. 19, 2009

(51) Int. Cl.
*F02C 1/00* (2006.01)

(52) U.S. Cl. ..... 60/753; 428/34.6; 415/173.4

(58) Field of Classification Search ..... 60/752–760; 428/34.6, 313.7; 415/116, 173.4, 173.5, 415/174.4, 200, 213.1
See application file for complete search history.

(56) References Cited

U.S. PATENT DOCUMENTS

| | | | | |
|---|---|---|---|---|
| 710,130 | A * | 9/1902 | Weiss | 60/39.48 |
| 3,170,504 | A * | 2/1965 | Lanning | 431/328 |
| 4,087,199 | A * | 5/1978 | Hemsworth et al. | 415/173.3 |
| 4,199,936 | A | 4/1980 | Cowan et al. | |
| 5,014,815 | A * | 5/1991 | Arcas et al. | 181/213 |
| 5,024,058 | A * | 6/1991 | Shekleton et al. | 60/752 |
| 5,181,379 | A | 1/1993 | Wakeman et al. | |
| 5,233,828 | A | 8/1993 | Napoli | |
| 5,279,127 | A | 1/1994 | Napoli | |
| H1380 | H * | 12/1994 | Halila et al. | 60/757 |
| 5,483,794 | A | 1/1996 | Nicoll et al. | |
| 5,687,572 | A | 11/1997 | Schrantz et al. | |
| 5,816,777 | A | 10/1998 | Hall | |
| 5,833,450 | A * | 11/1998 | Wunning | 431/215 |
| 5,970,715 | A | 10/1999 | Narang | |
| 6,013,592 | A | 1/2000 | Merrill et al. | |
| 6,197,424 | B1 | 3/2001 | Morrison et al. | |
| 6,235,370 | B1 | 5/2001 | Merrill et al. | |

(Continued)

FOREIGN PATENT DOCUMENTS

EP 0486133 A1 5/1995

(Continued)

OTHER PUBLICATIONS

E. Utriainen, B. Sundén; "Evaluation of the Cross Corrugated and Some Other Candidate Heat Transfer Surfaces for Microturbine Recuperators"; Transactions of the ASME; Jul. 2002; vol. 124; pp. 550-560; XP009108742.

*Primary Examiner* — Michael Cuff
*Assistant Examiner* — Phutthiwat Wongwian

(57) ABSTRACT

A ceramic hybrid structure (207, 502, 602, 608) that includes a wavy ceramic matrix composite (CMC) wall (214, 532, 603, 609) bonded with a ceramic insulating layer (230, 538, 604, 610) having a distal surface (242) that may define a hot gas passage (250, 550, 650) or otherwise be in proximity to a source of elevated temperature. In various embodiments, the waves (216, 537, 637) of the CMC wall (214, 532, 603, 609) may conform to the following parameters: a thickness (222) between 1 and 10 millimeters; an amplitude (224) between one and 2.5 times the thickness; and a period (226) between one and 20 times the amplitude. The uninsulated backside surface (218) of the CMC wall (214) provides a desired stiffness and strength and enhanced cooling surface area. In various embodiments the amplitude (224), excluding the thickness (222), may be at least 2 mm.

18 Claims, 7 Drawing Sheets

U.S. PATENT DOCUMENTS

| | | | | |
|---|---|---|---|---|
| 6,287,511 | B1 | 9/2001 | Merrill et al. | |
| 6,655,147 | B2 | 12/2003 | Farmer et al. | |
| 6,709,230 | B2 | 3/2004 | Morrison et al. | |
| 6,733,907 | B2 * | 5/2004 | Morrison et al. | 428/699 |
| 6,746,755 | B2 | 6/2004 | Morrison et al. | |
| 6,758,653 | B2 | 7/2004 | Morrison | |
| 6,767,659 | B1 | 7/2004 | Campbell | |
| 6,984,277 | B2 | 1/2006 | Morrison et al. | |
| 7,093,359 | B2 | 8/2006 | Morrison et al. | |
| 7,179,524 | B2 | 2/2007 | Merrill et al. | |
| 7,726,936 | B2 * | 6/2010 | Keller et al. | 415/173.4 |
| 2009/0252907 | A1 * | 10/2009 | Keller et al. | 428/34.6 |

FOREIGN PATENT DOCUMENTS

| | | |
|---|---|---|
| JP | 11101436 | 9/1999 |

* cited by examiner

WAVY CMC WALL HYBRID CERAMIC APPARATUS

FIELD OF THE INVENTION

The present invention relates generally to a hybrid apparatus including a wavy wall of ceramic matrix composites (CMCs) bonded to a ceramic insulating layer, the wall having specified wave parameters in various embodiments. The hybrid apparatus may be a component of a gas turbine engine, such as a duct-like component wherein the ceramic insulating layer defines a hot gas passage.

BACKGROUND OF THE INVENTION

Engine components that are exposed to the hot combustion gas flow of modern combustion turbines are required to operate at ever-increasing temperatures as engine efficiency requirements continue to advance. Ceramics typically have higher heat tolerance and lower thermal conductivities than metals. For this reason, ceramics have been used both as structural materials in place of metallic materials and as coatings for both metal and ceramic structures. Ceramic matrix composite (CMC) wall structures with ceramic insulation outer coatings, such as described in commonly assigned U.S. Pat. No. 6,197,424, have been developed to provide components with the high temperature stability of ceramics without the brittleness of monolithic ceramics.

Further as to the relatively lower thermal conductivity of CMCs, it is known to use radiation cooling, such as described in commonly assigned U.S. Pat. No. 6,767,659, and/or convective cooling or impingement cooling on back surfaces of component walls. However, backside cooling efficiency is reduced by the low thermal conductivity of ceramic material and by the fact that the wall thickness of a CMC structure, to achieve a desired strength, may be thicker than an equivalent metal structure. U.S. Pat. No. 5,687,572 teaches a backside impingement-cooled cylindrical ceramic liner of a combustor attached by pins to an outer metal shell. This reference cites thicknesses expected to withstand particular loads, discusses that thinner liners have lower thermal stresses, and refers to an analysis of buckling. It does not deviate from a uniform cylindrical configuration of the ceramic liner.

More generally, the issues related to strength properties per unit weight or thickness and to the cooling of structures made with CMCs are of particular concern for gas turbine engine components that are exposed to or are near the hot combustion gas path. As one approach to address these issues, a CMC lamellate wall structure with a high temperature ceramic insulation coating, commonly referred to as friable grade insulation (FGI), is disclosed in commonly assigned U.S. Pat. No. 6,197,424. Current materials of this type provide strength and temperature stability to temperatures approaching 1700° C. Also, the commonly assigned U.S. Pat. No. 6,709,230 describes cooling channels in a ceramic core of a gas turbine vane behind an outer CMC airfoil shell, and commonly assigned U.S. Pat. No. 6,746,755 uses ceramic matrix composite cooling tubes between CMC face sheets to form a CMC wall structure with internal cooling channels.

Notwithstanding these advances, further improvements in the design of hybrid CMC/ceramic insulating layer apparatuses are desired to support further applications of such structures in gas turbine engines, particularly in those engines in which an increase in the firing temperatures is expected and/or greater loads are imposed on the transition.

BRIEF DESCRIPTION OF THE DRAWINGS

The invention is explained in the following description in view of the drawings that show.

DETAILED DESCRIPTION OF THE INVENTION

The present inventors have appreciated that uses of ceramic matrix composites (CMCs) in gas turbine engine components exposed to high temperatures must take into account their relatively low thermal conductivity as well as difficulties related to the fabrication of intricate cooling passages, such as may be needed in part to overcome the relatively low thermal conductivity. Rather than solely utilizing more traditional approaches, such as developing specific cooling passage technologies for CMCs (some of which novel approaches are referred to herein), the present inventors conceived of forming and using hybrid apparatuses comprising a relatively thin and wavy CMC wall with a ceramic insulating material on one side, the latter suitable for direct exposure to a hot gas passage of a gas turbine engine or other exposure to elevated temperatures, while maintaining the other uninsulated side with an exposed wavy form providing an increased surface area for cooling, in such a way as to increase stiffness and strength along desired axes, while also achieving a desired thermal transfer across, and cooling of, the thin and wavy CMC wall.

This approach, which involves imparting a designed waviness to the CMC thin wall, overcomes the relatively low thermal conductivity of CMCs yet provides a structure of sufficient stiffness and strength in one or more desired axes. In some embodiments the hybrid wavy CMC wall/ceramic insulating structure may form only part of a component or apparatus, and in other embodiments an entire component may be formed of the inventive structure. When utilized in gas turbine engine components, the ceramic insulating layer may comprise a wearable or abradable insulation, and/or it may define an insulated hot gas flow passage.

Features of the invention may be appreciated by reference to the appended figures and table, which are meant to be exemplary and not limiting. Prior to presentation of specific embodiments of the invention, however, a discussion is provided of a common arrangement of elements of a prior art gas turbine engine into which may be provided embodiments of the present invention.

Figure 1:
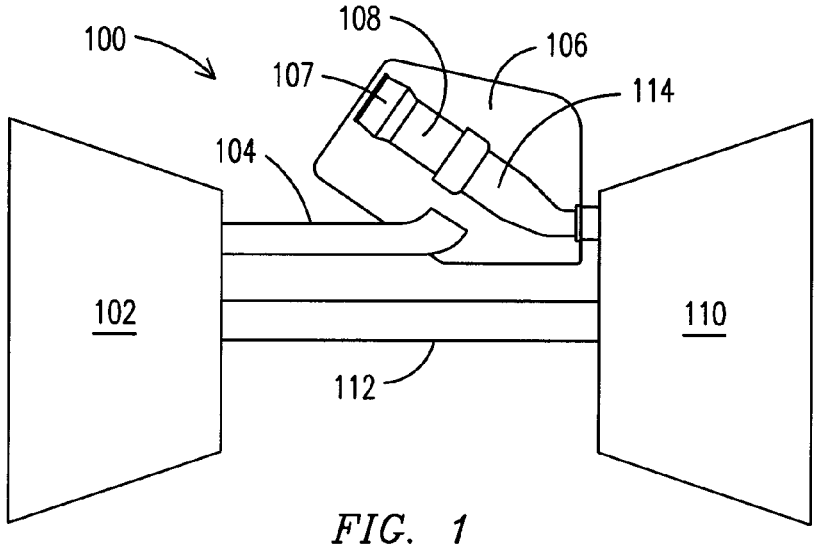
FIG. 1 (PRIOR ART)
FIG. 1 is a schematic depiction showing the major components of a modern gas turbine engine.

FIG. 1 provides a schematic cross-sectional depiction of a prior art gas turbine engine 100 such as may be improved with various embodiments of the present invention. The gas turbine engine 100 comprises a compressor 102, a combustor 107, and a turbine 110. During operation, in axial flow series, compressor 102 takes in air and provides compressed air to a diffuser 104, which passes the compressed air to a plenum 106 through which the compressed air passes to the combustor 107, which mixes the compressed air with fuel in a burner. Combustion occurs in a combustion chamber 108 downstream of the combustor 107. Further downstream combusted gases are passed via a transition 114 to the turbine 110, where the energy of combustion is extracted as shaft power. A shaft 112 is shown connecting the turbine to drive the compressor 102, and may also be connected to an electrical generator (not shown).

Figure 2A:
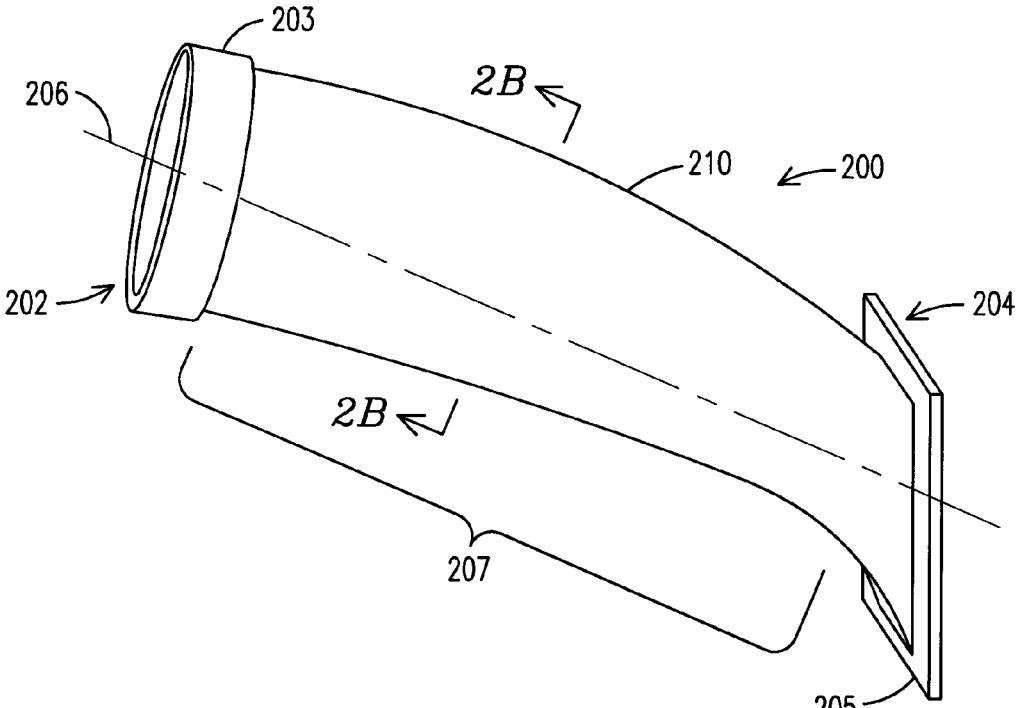
FIG. 2A is a perspective view of a typical transition of a gas turbine engine.

As may be appreciated, a transition such as the transition 114 of FIG. 1 is exposed to structural and thermal challenges based on its position immediately downstream of the combustor 107 and the desire to operate turbines at the highest feasible temperature range. FIG. 2A provides a perspective view of a transition 200 of a gas turbine engine (such as shown in FIG. 1) however comprising features in accordance with the present invention. Transition 200 has an upstream end 202, a downstream end 204, and an outer surface 210 that may be exposed to flows of fluid, such as compressed air from a compressor, while such fluid is en route to a combustor intake. The flow of such fluid may make the transition suitable for backside cooling under appropriate circumstances. At the upstream end 202 is an inlet flange 203 that connects to the combustion chamber, and at the downstream end 204 is an exit flange 205 that connects to the turbine.

Given combustion dynamics, aerodynamic pressure forces, and associated vibrations imparted to transition 200, as well as thermally induced stresses, there is a need for stiffness along a flow-based axis, shown by axis line 206. Considering the temperature tolerance of CMCs and the desired operating temperature range of gas turbine engines, there also is a need to deal with insulation of the hot gas path 250 (see FIG. 2B) defined by the transition 200 in a way that provides a desired operating temperature for the CMC material.

Figure 2B:
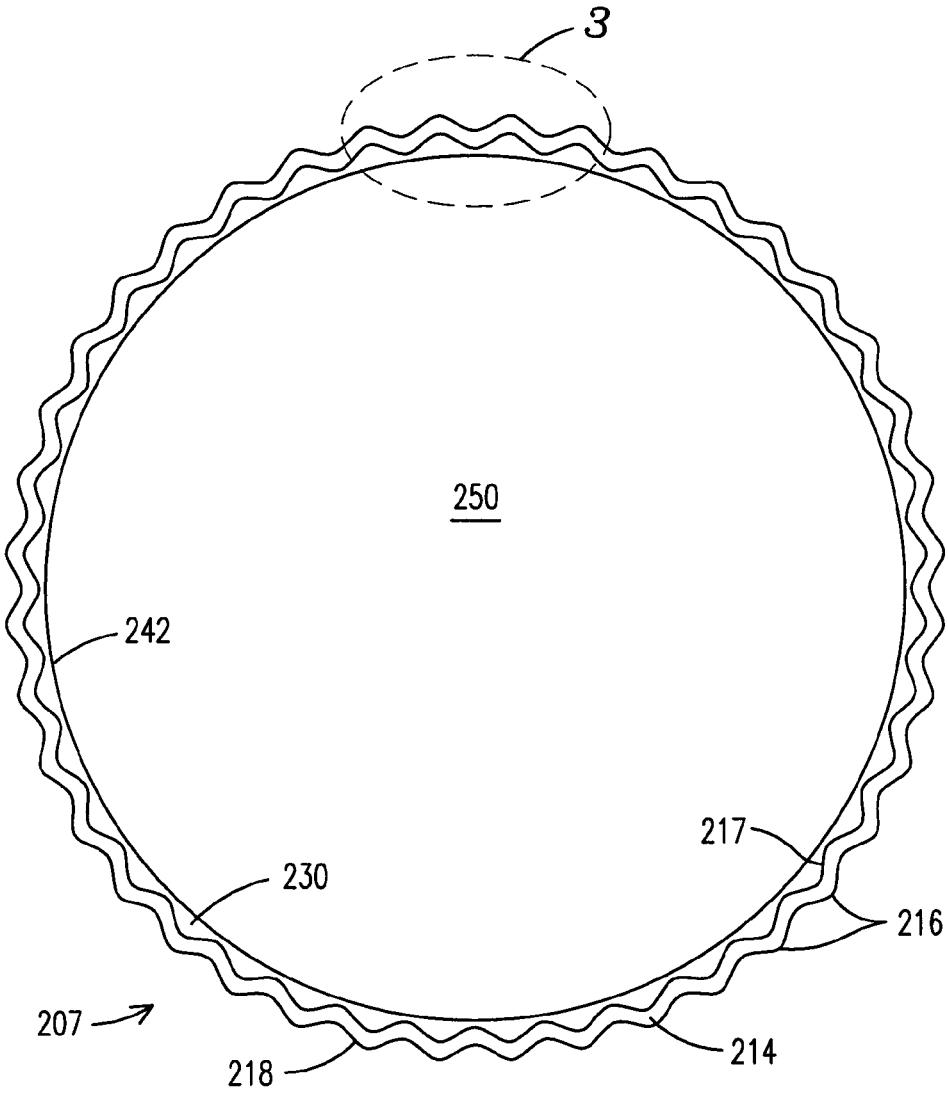
FIG. 2B provides a cross-sectional view of the transition of FIG. 2A taken along line B-B of FIG. 2A, showing features of the present invention.

In view of these considerations and criteria, the transition 200 is an apparatus that comprises a hybrid ceramic structure 207, also referred to as a sub-combination, comprising, as shown in FIG. 2B, a wavy CMC wall bonded to a ceramic insulating layer. At its forward and rearward ends, the hybrid ceramic structure 207 joins, respectively, the inlet flange 203 and the exit flange 205.

Certain features of the hybrid ceramic structure 207 are better viewed in FIG. 2B, which is a cross section view taken along line B-B of FIG. 2A. As may be so viewed, a wavy CMC wall 214 is designed and constructed so as to provide a desired stiffness and strength, leading to a desired robustness, while also being sufficiently thin so as to benefit from external backside cooling during operation. In particular, a given degree of stiffness may be obtained with the present invention by using a thinner CMC wall than would otherwise be necessary with a non-wavy CMC wall of the prior art. The CMC wall 214 comprises waves 216, parameters of which are described in greater detail below, which are manifested exteriorly by a first wavy surface 217 and a second wavy surface 218 (the "backside" surface). While not meant to be limiting, the waves 216 may be substantially aligned with a flow-based axis (i.e., 206) extending through the hot gas passage, so as to provide a desired resistance to bending along the length of the transition 200. Two-dimensional and/or three-dimensional weaves of CMC fibers may be utilized in various embodiments to form the CMC wall 214, with combinations of such weaves utilized to provide a desired performance for a particular embodiment. Bonded to the first wavy surface 217 of the CMC wall 214 is a ceramic insulating layer 230 that has a distal surface 242 that is smooth (not wavy) due to a varying thickness of the layer 230 and defines a hot gas passage 250. Thus, the present invention provides for improved stiffness/strength for a given thickness of CMC wall, or conversely, a thinner wall for a required stiffness/strength parameter; it presents an increased surface area on its non-insulated back side for improved radiant, convective or impingement cooling; and it also provides a desired non-wavy surface to the hot combustion gas flow.

In view of the previously noted development of CMC components for turbines and other high temperature applications, and also recognizing that adding corrugations to metal turbine components are known (for example, see U.S. Pat. Nos. 5,970,715, 5,279,127, and 5,181,379), the latter having the corrugations of the structural metal directly along the hot gas passage (and aligned transversely to the flow-based axis), it is appreciated that in various embodiments of the present invention the waves of the second wavy surface are exposed for an effective backside cooling, whereas the waves of the first wavy surface do not define the shape of the distal surface that defines the hot gas passage or is otherwise closer to a source of high temperature. This arrangement of elements is effective to provide a strong yet thin CMC wall insulated from extreme temperature and capable of a desired thermal conductivity for cooling.

In various embodiments the ceramic insulating layer is of a wearable type, such as those described in commonly assigned U.S. Pat. Nos. 6,013,592, 6,197,424, 6,235,370, and 6,287,511, which are incorporated by reference herein as to such teachings. In various embodiments, the ceramic insulating layer comprises a ceramic insulating material that is non-reinforced and has a heterogeneous microstructure.

Construction of apparatuses of the present invention may be accomplished by any methods known to those skilled in the art. Examples of construction methods, and of particular ceramic materials, are provided in the immediately above-cited patents and also in commonly assigned U.S. Pat. Nos. 6,733,907 and 7,093,359, which are incorporated by reference herein as to such teachings. Further to construction approaches, the hybrid ceramic structure may be manufactured in numerous ways that include, but are not limited to, the following four examples:

1. The ceramic insulating layer can be cast first and machined on the outside to have a wavy surface that matches the first wavy surface. Then ceramic fabric can be laid up on that wavy surface and processed into the wavy CMC wall with the appropriate matrix, etc.

2. The CMC can be laid up in a mold to a desired specific shape. After it is fully fired, the ceramic insulating layer can be cast inside it, along the first wavy surface.

3. The CMC can be fiber wound as a cylinder and then formed into a wavy structure. The ceramic insulating layer can then be cast on the CMC.

4. The ceramic fiber can be woven as a three-dimensional structure, processed into a CMC structure having the desired thin waves, and the ceramic insulating layer can be cast inside the CMC thereafter.

Construction methods may include steps for joining this hybrid ceramic structure with other sub-components of a single apparatus, for example in the case of a transition, there may be steps to join the hybrid ceramic structure with the inlet and outlet flanges.

It is noted that transitions made according to the present invention may have a dampening effect on the vibrations driven by combustion dynamics, in terms of damping, transfer, direct damage, or any combination of these. Simple panel or membrane modes of vibration will result in complex stress states by virtue of the anisotropic CMC material oriented in a non-planar, wavy configuration. In-plane shear is induced by simple bending, in addition to interlaminar shear—both of which are known to contribute significantly to damping in composites.

More particularly as to certain embodiments of the present invention, the present inventors have determined that a hybrid ceramic apparatus comprising a relatively thin and wavy CMC wall having wave peaks and troughs arranged so as to provide a desired resistance to bending, and a ceramic insulating layer bonded to one surface of the CMC wall, provides a particularly stiff and strong, relatively low weight, and relatively low cost hybrid ceramic apparatus when the wave characteristics and CMC thickness fall within defined ranges. Advantageously, such apparatuses comprising hybrid ceramic structures conforming to the parameter ranges also provide unexpectedly favorable heat management characteristics.

Figure 3:
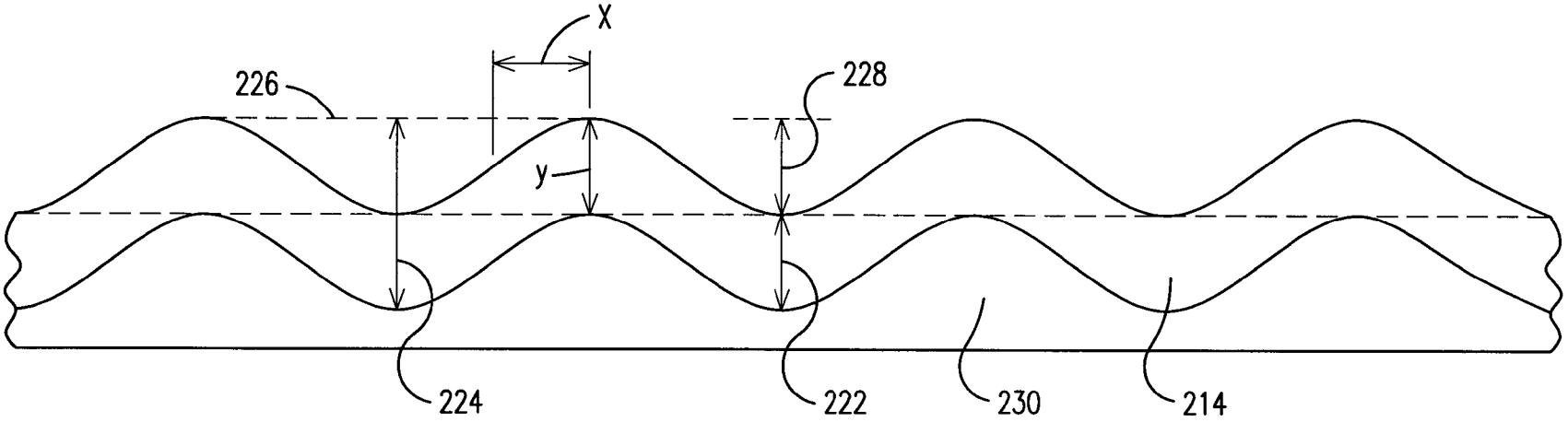
FIG. 3 is a linearized depiction of the portion of the CMC wall shown in the box of FIG. 2B, provided to describe parameters of the waves of the CMC wall.

These ranges may be understood by reference both to Table 1 and FIG. 3. FIG. 3 is an enlarged and linearized representation of the boxed section of FIG. 2B that provides greater details of the wavy CMC wall 214, and a corresponding portion of the associated ceramic insulating later 230. Wavy CMC wall 214 has a thickness 222, an amplitude 224, and a period or wavelength 226 each of which falls within specific ranges described below. Also, a wave height, 228, is shown to be equal to the amplitude 224 less the thickness 222. The parameters x and y also are shown in FIG. 3 and are evaluated in Table 1, below. The parameter x is equal to one-fourth of the period or wavelength 226 (also referred to as pitch by some in the art), and the parameter y equals one-half of the amplitude 224 (also referred to in some embodiments as depth by some in the art).

Table 1 demonstrates the derivation of desired ranges of parameters for a relatively thin and wavy CMC wall used in various embodiments of hybrid ceramic structures of the present invention. Hypothetical examples of wavy CMC walls in Table 1 are defined by parameters described in relation to FIG. 3. These examples are divided into two groups: a first group for which x/y=1 and having y/t varying from 1 to 2; and a second group for which x/y=5 and having y/t also varying from 1 to 2; Using a known formula to calculate the second moment of area, designated I, a value for the second moment of area is determined for each member of the three groups. The second moment of area is a measure that indicates resistance to bending along an axis substantially parallel with the waves so formed. Each such value, designated as I Corr (for corrugated), is then compared to a calculated value for a second moment of area for a flat wall having the same CMC wall thickness. This is shown as I Flat. Such comparisons are shown in the column identified as Moment Ratio. A Strength Ratio, designated as the moment, σ, of a flat object divided by a corrugated object, $\sigma_{flat}/\sigma_{corr}$, is calculated based on the following formula:

$$\frac{\sigma_{flat}}{\sigma_{corr}} = \frac{I_{corr}}{I_{flat}} \cdot \frac{y_{flat}}{y_{corr}}$$

where $y_{flat}$ is half the thickness of the flat object.

The comparisons identify and better characterize aspects of the conceived thin and wavy CMC structural wall. The data show the stiffness and strength obtained with thin wavy wall structures of the present invention. An added benefit beyond these properties as to the use of such structures in gas turbines and other devices exposed to high temperatures is the unexpected additional benefit of relatively easy cooling, such as by convection and/or radiation, owing to the relative thinness of the wavy CMC wall and its exposed backside wavy surface (despite the recognized low thermal conductivity of CMC).

During the data development and analysis, the present inventors realized that the y/t parameter, which may be conceptualized as a "wave-height-to-thickness ratio," governs the Moment Ratio. This can be seen by comparing the increase in y/t with the increase in second moment ratio for the two groups. This shows that y/t controls the Moment Ratio whereas neither x/y nor period of wave, reflected in x, controls the Moment Ratio.

Figure 4:
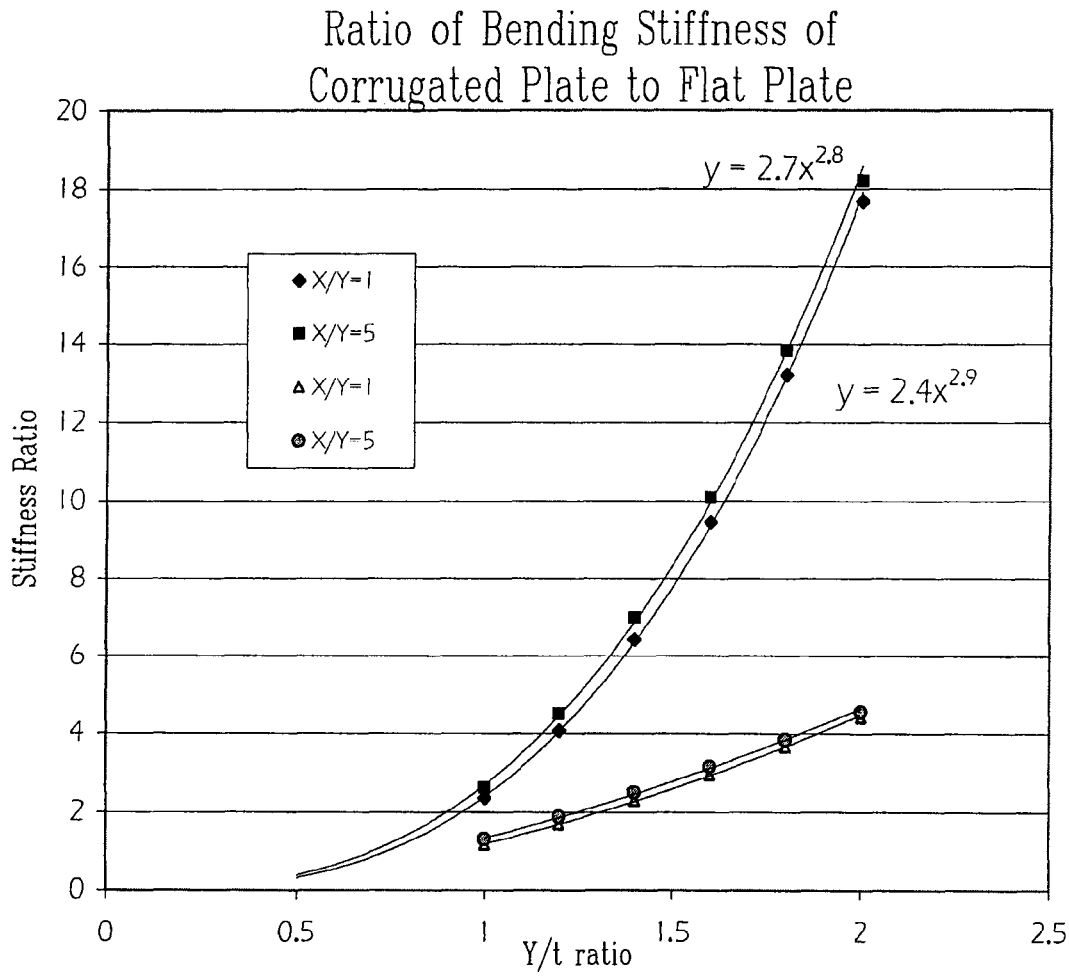
FIG. 4 is a graph showing the relationship between the y/t ratio and stiffness and strength ratios for two data sets.

The data from Table 1 are shown graphically in FIG. 4. This shows, first, that regardless whether x/y is one or five, the ratio of bending stiffness of the wavy design to a flat plate is substantially the same at a given y/t value. The strength ratios also are plotted in FIG. 4, and present less steep curves that are correlated to y/t. Significantly, strength (or load carrying capability) is also increased, thus enabling achievement of all benefits simultaneously.

Based on this, embodiments of the present thin-walled CMC structures have a desired strength/stiffness combination, and additionally provide a good and unexpected advantage: ability to be cooled despite being constructed with a traditionally poor thermal conductor. Embodiments of ceramic hybrid structures including wavy CMC walls conforming to the following parameter ranges are determined to provide a desirable combination of stiffness, strength, and thermal conductivity, particularly for gas turbine structures and components near or defining a hot gas passage in a gas turbine engine. The ranges for the parameters are as follows:

t ranges from 1 to 10 millimeters ("mm");

y/t ranges from 0.75 to 3.0; and x/y ranges from 0.5 to 2.0.

In that the parameter x is one-fourth of the wave period and y is one-half of the wave amplitude, the latter range may alternatively be defined in terms of a period being between 1 and 4 times the wave amplitude.

Also, in various embodiments the height of the wavy CMC wall, which is the wave amplitude (2y) minus the thickness, t, is at least 2 mm. This parameter limit, in combination with the above parameters, has been determined to provide a desired performance for apparatuses of the present invention. It is noted that the height may alternatively be referred to by its relationship to amplitude, namely that it is the amplitude excluding the thickness.

While the above ranges in their respective broadest interpretations include their respective endpoints, each of these ranges also is understood to disclose all values therein and all sub-ranges therein, including any sub-range between any two numerical values within the range, including the endpoints. For example, as to the stated range of 0.75 to 3.0 for y/t, this is understood to include the sub-ranges 0.75 to 1.5, 1 to 2, 2 to 3, and other sub-ranges within the stated range of 0.75 to 3.0.

Thus, while it has generally been known in related and unrelated arts that corrugation improves rigidity along a particular axis, the present hybrid CMC invention relates to the particular achievement of a desired stiffness and strength, combined with an unexpected benefit of cooling effectiveness through use of a relatively thin wall wavy CMC structure in which the backside wavy surface of the wavy CMC wall is exposed so as to provide for a desired cooling effect. Embodiments of the present hybrid CMC invention comprise a ceramic insulating layer bonded to one side of the wavy, relatively thin CMC wall, insulating the wall from heat on the non-bonded side of the ceramic insulating layer (such as from a hot gas passage), the waviness adding surface area for enhanced bonding between the CMC wall and the ceramic insulating layer, such as enhanced bonding on a macroscopic level, and the other side of the wavy, relatively thin CMC wall having its wavy surface exposed to provide a desired cooling effect. Reference is made to commonly assigned U.S. Pat. No. 6,984,277, which describes one embodiment providing bond enhancement structures formed as waves in an upper surface of a layer of CMC material, that surface contacting a ceramic insulating material that comprises hollow ceramic spheres. The layer of CMC material in that embodiment may comprise rods or cooling passages therein. However, the side opposite the side with the waves in that prior art patent is flat and does not afford the level of thermal conductivity provided by embodiments of the present invention, which have such backside surface having an exposed wavy surface.

As to one class of embodiments, one may construct a duct-shaped member comprising a combination of an appropriately wavy thin-walled CMC wall layer bonded to a more internally disposed ceramic insulating layer that defines a path through which flows fluid at an elevated temperature (such as hot combusted gas). This class is exemplified by the transition of FIGS. 2A and 2B, which may be installed in a suitable gas turbine engine such as that depicted in FIG. 1. The wavy hybrid structure 207 joins the inlet flange 203 at a forward end and the exit flange at a rearward end, such as through respective regions in which the duct-like transition wall transitions from the hybrid CMC structure 207 to a more conventional CMC structure (for instance, lacking the waves conforming with the ranges provided above). The inlet flange 203 may be made of a metal alloy or CMC composite or other material but which is not wavy in this embodiment, and the exit flange 205 which may likewise be of a different material and not be formed in accordance with the above teachings for a hybrid ceramic structure. As shown in FIG. 2A, the exit flange 205 may be formed in a generally rectangular shape, and there is a transition in shapes from the generally cylindrical shape of the main portion of the transition to this generally rectangular shape of the exit flange 205. In view of the waves, the thickness, and other parameters of the CMC wall varying from the above ranges in such transition regions near the inlet flange 203 and exit flange 205, supplemental forms of cooling, as are known to those skilled in the art, may be provided in various embodiments for such transition regions. Advantageously, in this embodiment the surface of the ceramic insulating layer that defines the hot gas path is generally tubular in shape and lacks the waves of the thin CMC wall material, thereby ensuring the desired smooth flow of hot gas there through.

Another example regarding such duct-shaped components is a ring segment that may form part of a blade ring that surrounds a turbine blade. The role of a blade ring, and the ring segments that form it, is to surround a turbine blade and tightly define the space within which the blade rotates. Aspects of this are taught in co-assigned U.S. Pat. No. 6,758,653, which in incorporated by reference for its teachings of blade rings and their components, and also for its specific teachings of a support member with cooling passages that may be optionally provided in embodiments of the present invention.

Figure 5A:
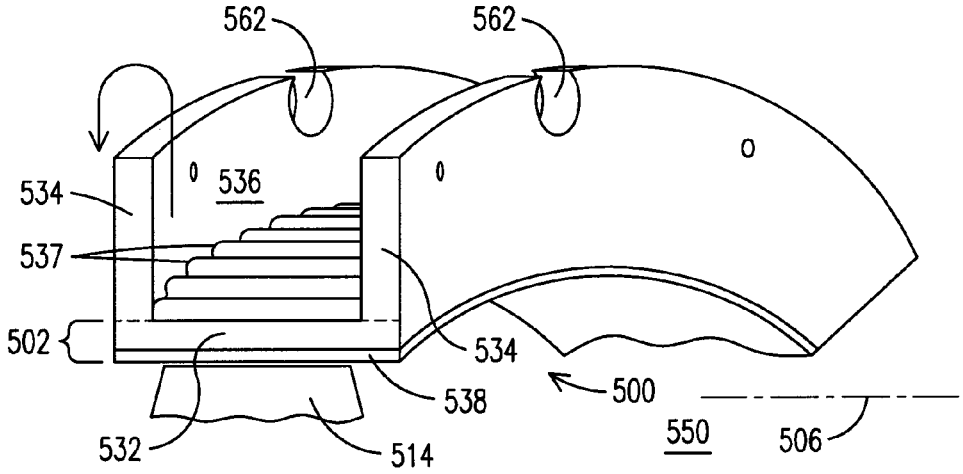
FIG. 5A is a perspective view of a ring segment of the present invention.

FIG. 5A provides a perspective drawing of one embodiment of a ring segment 500 having features of the present invention. The ring segment 500 is comprised of two parallel positioned spaced apart support members 534, here comprised of CMC, and a hybrid CMC structure 502 comprising a wavy CMC wall 532 and a ceramic insulating layer 538 in close proximity to a blade tip 514. When the support members are comprised of CMC they may be formed with and thus are integral with the hybrid CMC structure 502 (indicated by dashed lines at junction). The support members 534 may be alternatively be comprised of a metal alloy or other materials, and may comprise, as depicted in FIG. 5A, one or more grooves 562 that may be provided to relieve hoop stresses that may be imparted during operation. The waves 537 of the wavy CMC wall 532 are observable along a viewable inside wall 536 of one of the support members 534. As to laterally disposed portions of the waves 537 which lie under the spaced apart support members 534, heat from these portions is conducted axially outward through the support members 534, which are exposed to a flow of cooling fluid (not shown). While not meant to be limiting, the waves 537 are substantially aligned with a flow-based axis 506 extending through a hot gas passage 550 defined in part by the ring segment 500. This orientation of the waves 537 provides a desired resistance to bending from front to back (i.e., upstream to downstream) ends of the ring segment 500. In various embodiments, the properties of the wavy CMC wall 532 fall within the parameters described above and claimed herein.

The embodiment of FIG. 5A is cooled by backside cooling resulting from a flow of cooling fluid provided through pathways known in the art. Alternately, the use of radiation cooling techniques may be used, as noted above. An optional support member comprising cooling passages, as taught in co-assigned U.S. Pat. No. 6,758,653, may also be provided in some embodiments. FIG. 5B depicts one such embodiment. One or a plurality of cooling passages 558 may be formed in support member 534, which in this embodiment extends over the outer surface of wavy wall 532, to permit a portion of cooling fluid 524 to pass into a gap 544 to provide cooling for wavy CMC wall 532. Sealing members such as O-ring seal 560 may be provided to direct the flow of the cooling fluid 524. Cooling fluid can be directed to exit the gap 544 via leakage through seals 560 and/or through circumferential seals between adjacent segments (not shown). Such leakage flows are typically adequate for cooling CMC components. The size of the opening 526, and cooling passages 558 and the pressure of the cooling fluid 524 may be selected to provide a desired flow rate of cooling fluid 524 through the gap 544. The temperature of the support member 534, which in this depicted embodiment is made of metal, is maintained below a desired upper limit as a result of the combination of the insulating action of ceramic insulating layer 538 and wavy CMC wall 532 and the active cooling provided by cooling fluid 526. The thermal conductivity characteristic of the wavy CMC wall 532, as well as that of the ceramic insulating layer 538, which together comprise the hybrid CMC structure 502 (see FIG. 5C), is selected to be sufficiently low to maintain the support member 534 below a predetermined temperature during operation of the combustion turbine engine so that it is possible to provide direct contact between the wavy CMC wall 532 and the metal support member 534 without the need for any intervening thermal insulating material. Such contact will occur at least along portions of the mating surfaces of arcuate portions 551, 552 and the extending portions 546, 548.

Also, in view of the fact that some degree of abrasion is tolerated in an attempt to minimize the amount of combustion gas 516 that passes around blade tip 514 without passing over blade 512, it is expected that blade tip 514 may on occasion make contact with the ceramic insulating layer 538, which is abradable. This will thereby impose a mechanical force into wavy CMC wall 532. From a design perspective, wavy CMC wall 532 must be able to absorb such force without failure. A shroud assembly 530 of FIG. 5B accommodates such rubbing forces by allowing such force to be transferred to the metal support member 534. This is accomplished by controlling the maximum allowable dimension for gap 542 so that when blade tip 514 rubs against the shroud assembly 530, the wavy CMC wall 532 will deflect to reduce the gap to zero in at least one location opposed the blade 512 and remote from the arcuate portions 551, 552 so that the radially inner surface 540 of support member 534 provides support against the radially outer surface 544 of the wavy CMC wall 532. The support member 534 is designed to provide a predetermined resistance to further deflection of the wavy CMC wall 532 once the gap 542 is reduced to zero, thereby limiting the peak stress in the wavy CMC wall 532. The maximum dimension of gap 542 is selected to control the level of stress developed in the shroud member 530, in particular in the arcuate portions 551, 552 of CMC member 533, which comprises the wavy CMC wall 532 as well as the arcuate portions 551, 552, that fit within grooves 554, 556 of support member 534, as the wavy CMC wall 532 deflects during a rubbing event.

Figure 5C:
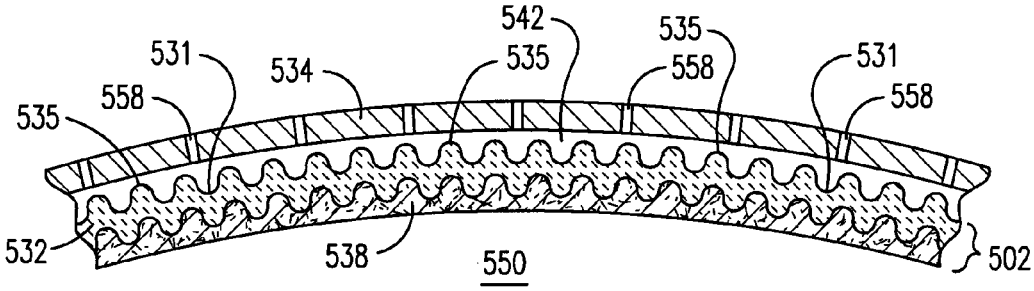
FIG. 5C is a partial cut-away view of a portion of the ring segment of FIG. 5B, taken along line C-C of FIG. 5B.
Figure 5B:
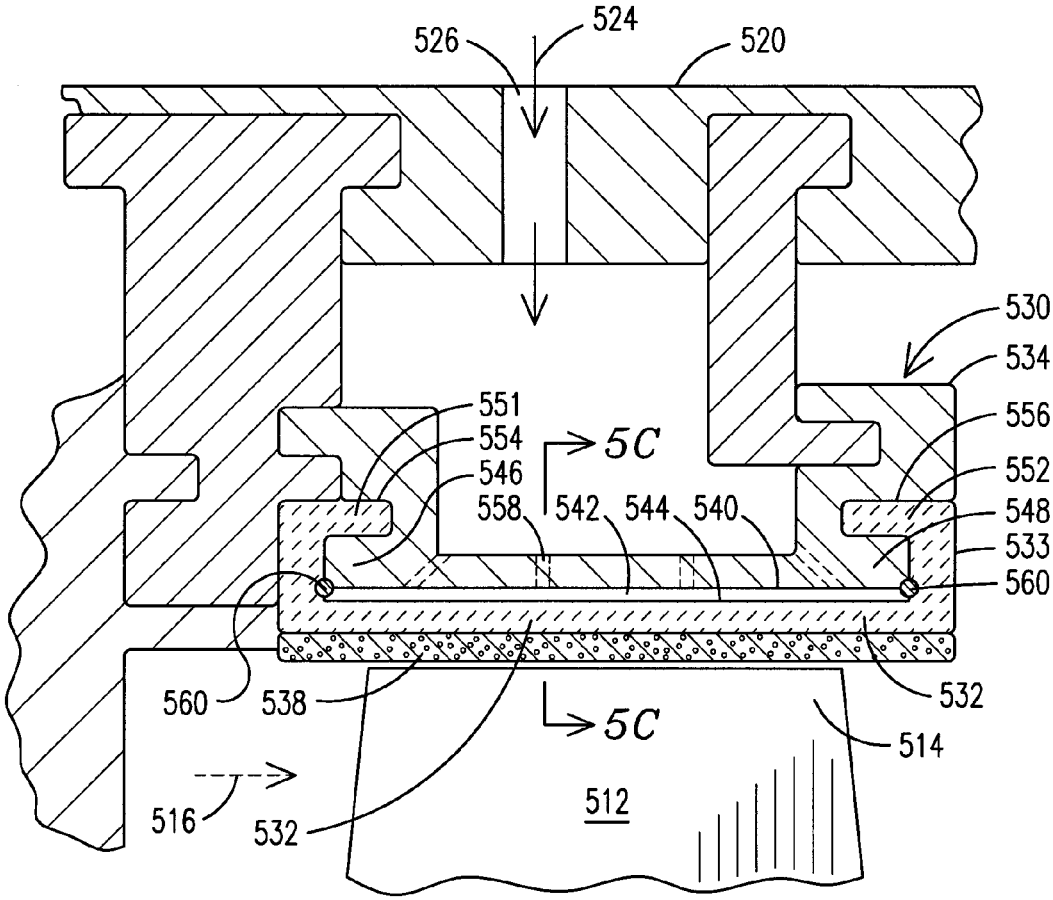
FIG. 5B is a cross-sectional view of a ring segment of the present invention.

Further to the features of the present invention, FIG. 5C provides a partial cross-section taken along line C-C of FIG. 5B. In FIG. 5C, the wave pattern of wavy CMC wall 532 is viewable, as is a cross-sectional view of the hybrid CMC structure 502 that also comprises the ceramic insulating layer 538 that defines hot gas passage 550. The cooling passages 558 are aligned with the troughs 531 of the waves of wavy CMC wall 532. In such alignment the cooling passages do not contact the peak points 535 directly upon a deflection of the wavy CMC wall 532. Alternately, the metal support member 534 may conform to the wavy surface 532 in close proximity to enhance radiative cooling effects.

For a curved type of duct-like structure, such as the transition and the ring segment described above, it is noted that the ranges above are meant to apply to a linearized modification of the waves as they exist in a curved configuration. A linearization essentially averages out the smaller wave measurements to the interior, and the larger wave measurements (such as peak to peak distance) to the exterior. For example, FIG. 3 is a linearized depiction of the boxed portion of FIG. 2B. Accordingly, claiming the parameter ranges on a linearized basis is meant to smooth and standardize the wave deviations due to curving a wave form.

Other gas turbine components that could potentially benefit from this invention include combustor liners, interstage turbine ducts, exhaust ducts, afterburner ducts, and exhaust nozzle components including nozzle flaps—virtually any high temperature component having a range of shapes, including flat, relying on backside cooling and having light weight and high stiffness. In some embodiments, such as for these components, the entire structure is comprised of a hybrid wavy wall bonded to ceramic insulation.

Also, the use of convective cooling of the wavy backside of the wavy CMC wall is not meant to be limiting. For example, U.S. Pat. No. 6,767,659 teaches coating a backside of a CMC composition with a high temperature emissive material and providing a metal element spaced apart from the CMC composition and defining a gap between the metal element and the ceramic matrix composite, whereby at least a portion of thermal energy exposed to the ceramic insulating material is emitted from the high temperature emissive material to the metal element. A cooling fluid may be made to flow by the backside of the metal element, thereby assisting in the cooling of the CMC composition. Accordingly, the teachings of U.S. Pat. No. 6,767,659 may be combined with the wavy CMC wall hybrid structure by addition of an emissive coating, and may also include a metal element spaced apart from the wavy CMC wall.

Further, other forms of cooling may be combined with the wavy CMC wall hybrid structure. Film cooling or effusion cooling through the hybrid CMC wall can also be used with the wavy construction—either separately or in combination with the above cooling techniques.

Figure 6A:
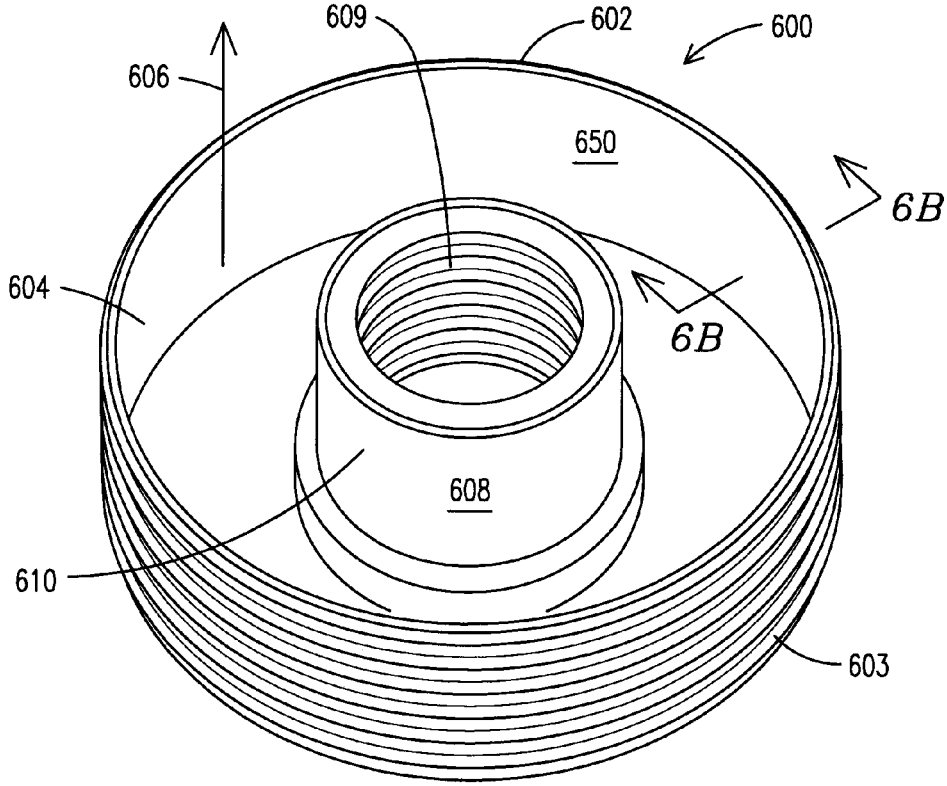
FIG. 6A is a perspective view of a combustor liner of the present invention.

FIG. 6A is a perspective view of a combustor liner 600 according to the present invention. Combustor liner 600 comprises an outer liner 602 that comprises a wavy CMC wall 603 and a more interiorly disposed ceramic insulating layer 604. An optional inner liner 608 comprises a wavy CMC wall 609 and a more exteriorly disposed ceramic insulating layer 610. The ceramic insulating layers 604 and 610 define a hot gas path 650 traveling along a flow-based axis 606.

Figure 6B:
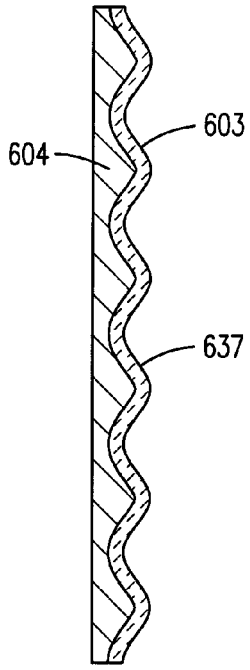
FIG. 6B is a partial cut-away view of a portion of the ring segment of FIG. 6A, taken along line B-B of FIG. 6A.

FIG. 6B is a partial cut-away view of a portion of the outer liner 602 of FIG. 6A, taken along line B-B of FIG. 6A. From this view it is clear that the orientation of the waves 637 are perpendicular to the flow based axis 606 (see FIG. 6A). This orientation functions to limit hoop stress. The above discussion and examples are not meant to be limiting as to the geometric form of the waves in embodiments of the present invention. That is, any type of wave geometric form may be utilized, including but not limited to: sinusoidal; rectangular; trapezoidal; and triangular.

The present invention may be combined with other approaches to the use of ceramic structures and components for gas turbines and for other devices that are subject to exposure to high temperatures. The ranges of parameters provided above to achieve a stiff (for example, along a desired axis) and strong yet relatively thin and effectively thermally conductive wavy CMC wall may be applied to structures and components that include not only the ceramic insulating layer, but that also may include cooling channels, multiple layerings forming the wavy wall, additional CMC walls, additional ceramic or other core or filler materials, and/or reinforcement pieces.

All patents, patent applications, patent publications, and other publications referenced herein are hereby incorporated by reference in this application in order to more fully describe the state of the art to which the present invention pertains, to provide such teachings as are generally known to those skilled in the art, and to provide such teachings as are noted through references herein.

While various embodiments of the present invention have been shown and described herein, it will be obvious that such embodiments are provided by way of example only. Numerous variations, changes and substitutions may be made without departing from the invention herein. Moreover, when any range is understood to disclose all values therein and all sub-ranges therein, including any sub-range between any two numerical values within the range, including the endpoints. Accordingly, it is intended that the invention be limited only by the spirit and scope of the appended claims.

The invention claimed is:

1. An apparatus for use in high temperature applications, the apparatus comprising a hybrid ceramic structure comprising:

a ceramic matrix composite (CMC) wall, at least a portion of which comprises sinusoidal waves, the waves extending a full thickness of the wall to define a first wavy surface and an opposed second wavy surface; and a ceramic insulating layer comprising a proximal surface bonded with the first wavy surface and comprising a distal surface for exposed to a combustion gas;

wherein the waves, on a linearized basis, have a thickness of 1 to 10 millimeters, an amplitude excluding the thickness of at least 2 millimeters, the waves amplitude further being 1.5 to 6.0 times the thickness, and a period of 1 to 4 times the wave amplitude; and wherein the waves of the second wavy surface are exposed for an effective backside cooling, and the first wavy surface and a varying thickness of the ceramic insulating layer define a contour of the distal surface.

2. The apparatus of claim 1, wherein the period is between 1 and 2 times the wave amplitude, inclusive.

3. The apparatus of claim 1, wherein the apparatus is a duct shape, defining, at least in part, a central passageway therein, the distal surface of the ceramic insulating layer presenting a non-wavy exposed surface for the passage of a hot gas there through.

4. The apparatus of claim 3, wherein the apparatus is a gas turbine transition comprising an upstream inlet flange and a downstream outlet flange, wherein the inlet flange and the outlet flange join with the hybrid ceramic structure that extends there between and the central passageway is a hot gas passage.

5. The apparatus of claim 3, wherein the apparatus is a gas turbine ring segment partly defining an annular boundary for gas turbine blades.

6. The apparatus of claim 5, wherein the apparatus is supported by two spaced apart support members.

7. The apparatus of claim 6, wherein the support members are comprised of CMC, and are formed and are integral with the apparatus.

8. The apparatus of claim 3, wherein the apparatus is a combustor liner having a hot gas path as the central passageway.

9. The apparatus of claim 1, additionally comprising an emissive coating on the second wavy surface.

10. A wavy transition for a gas turbine engine comprising:

a ceramic matrix composite (CMC) wall, at least a portion of which comprises sinusoidal waves, the waves extending a full thickness of the wall to define a first wavy surface and a second wavy surface, and a ceramic insulating layer, comprising a proximal surface bonded with the first wavy surface, and a distal surface defining a non-wavy hot gas passage for exposed to a combustion gas;

an upstream inlet flange; and a downstream outlet flange, wherein the inlet flange and the outlet flange join with the CMC wall that extends between them, and wherein the waves of the second wavy surface are exposed for an effective backside cooling and the waves of the first wavy surface do not define the shape of the distal surface.

11. The wavy transition of claim 10, wherein the waves, on a linearized basis, have a thickness between 1 and 10 millimeters, inclusive, an amplitude, excluding the thickness, of at least 2 millimeters, the waves' amplitude further being between 1.5 and six times the thickness, inclusive, and a period being in a range between one and four times the wave amplitude, inclusive.

12. The wavy transition of claim 11 wherein the period is between one and two times the wave amplitude, inclusive.

13. The wavy transition of claim 10, wherein the waves are substantially aligned with a flow-based axis extending through the hot gas passage.

14. The wavy transition of claim 10, wherein an amplitude of the wave, excluding a thickness of the waves, is at least 2 millimeters, the waves' amplitude further being between 1.5 and six times the thickness, inclusive, and a period being in a range between one and four times the wave amplitude, inclusive.

15. A ring segment for a gas turbine engine comprising:

a hybrid ceramic structure comprising a ceramic matrix composite (CMC) wall, at least a portion of which comprises sinusoidal waves, the waves extending a full thickness of the wall to define a first wavy surface and a second wavy surface; and a ceramic insulating layer, comprising a wavy proximal surface bonded with the first wavy surface, and a distal surface for exposed to a combustion gas;

wherein the waves of the second wavy surface are exposed for an effective backside cooling, and the waves of the first wavy surface do not define the shape of the distal surface.

16. The ring segment of claim 15, wherein the waves, on a linearized basis, have a thickness between 1 and 10 millimeters, inclusive, an amplitude, excluding the thickness, of at least 2 millimeters, the waves' amplitude further being between 1.5 and six times the thickness, inclusive, and a period being in a range between one and four times the wave amplitude, inclusive.

17. The ring segment of claim 16 wherein the period is between one and two times the wave amplitude, inclusive.

18. The ring segment of claim 15, wherein the waves are substantially aligned with a flow-based axis extending through the hot gas passage.

* * * * *